US005146980A

United States Patent [19]

Le Gauyer

[11] Patent Number: 5,146,980

[45] Date of Patent: Sep. 15, 1992

[54] PLATE TYPE HEAT ECHANGER, IN PARTICULAR FOR THE COOLING OF LUBRICATING OIL IN AN AUTOMOTIVE VEHICLE

[75] Inventor: Philippe Le Gauyer, Paris, France

[73] Assignee: Valeo Thermique Moteur, Le Mesnil-Saint-Denis, France

[21] Appl. No.: 630,254

[22] Filed: Dec. 19, 1990

[30] Foreign Application Priority Data

Dec. 21, 1989 [FR] France ..... 89 17002

[51] Int. Cl.[5] ..... F28F 3/00

[52] U.S. Cl. ..... 165/167; 165/165; 165/916

[58] Field of Search ..... 165/159, 161, 165, 166, 165/916, 167

[56] References Cited

U.S. PATENT DOCUMENTS 4,271,901 6/1981 Buchmüller ..... 165/165

FOREIGN PATENT DOCUMENTS 0124217 11/1984 European Pat. Off. .
0208957 1/1987 European Pat. Off. .
2729202 3/1978 Fed. Rep. of Germany .
974583 11/1984 Fed. Rep. of Germany .
3536316 4/1987 Fed. Rep. of Germany ..... 165/916
2215873 8/1974 France .
81/01327 5/1981 PCT Int'l Appl. ..... 165/916
4643 of 1890 United Kingdom ..... 165/159
116786 6/1918 United Kingdom .
351020 6/1931 United Kingdom .
2140908 12/1984 United Kingdom .

*Primary Examiner*—Allen J. Flanigan
*Attorney, Agent, or Firm*—Dennison, Meserole, Pollack & Scheiner

[57] ABSTRACT

A plate type heat exchanger, for effecting heat transfer between a first fluid and a second fluid, comprises a casing having an inlet and an outlet for the second fluid. A stack of plate elements is arranged within the housing, the plate elements being arranged in opposed pairs to define flow passages for the first fluid and flow passages for the second fluid, with means gving communication between the successive first fluid passages. In addition, at least one cross wall is disposed parallel to the plates within the casing, so as to divide the casing into at least two chambers, with the second fluid inlet being open into one chamber and second fluid outlet into another chamber, the cross wall having an opening for enabling the second fluid to flow from one chamber to the other.

12 Claims, 6 Drawing Sheets

FIG. 1
PRIOR ART
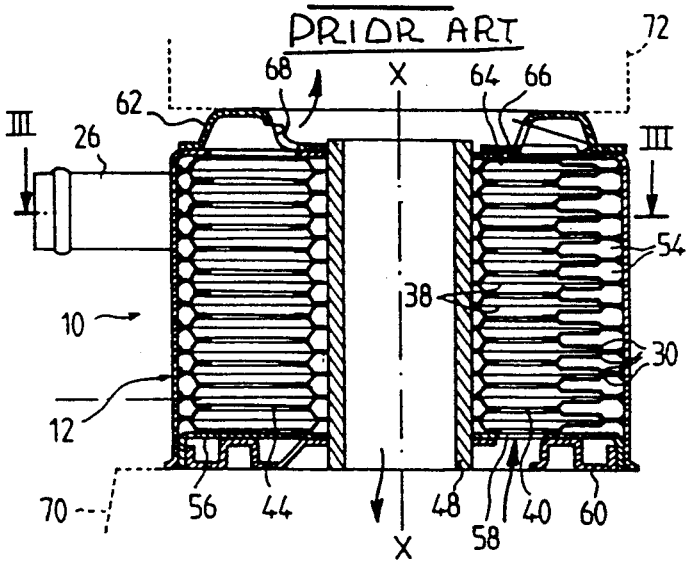
FIG. 2
PRIOR ART
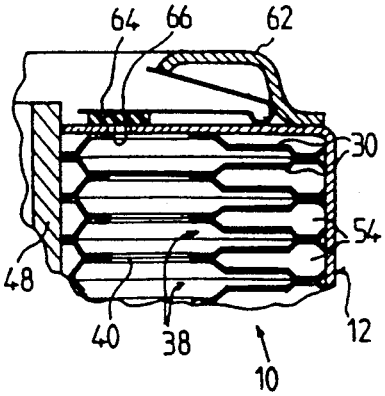
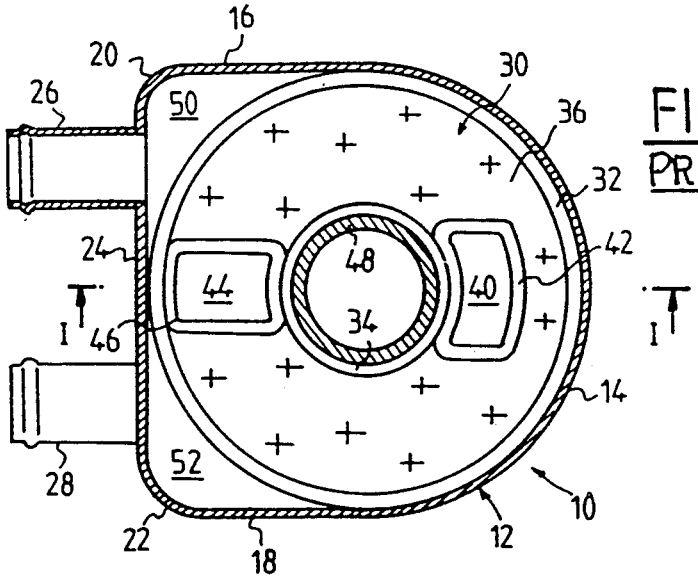
FIG. 3
PRIOR ART FIG. 4
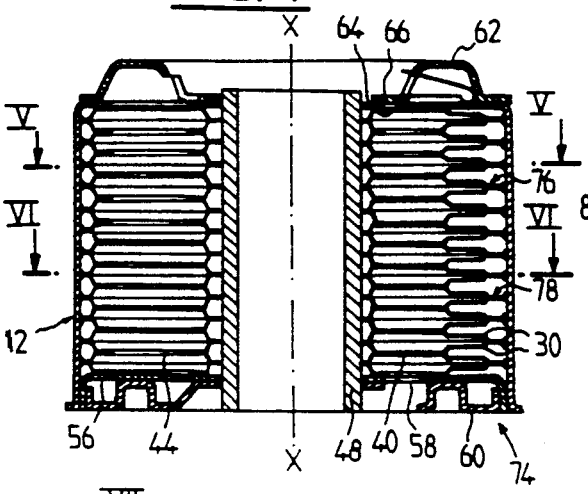
FIG. 7
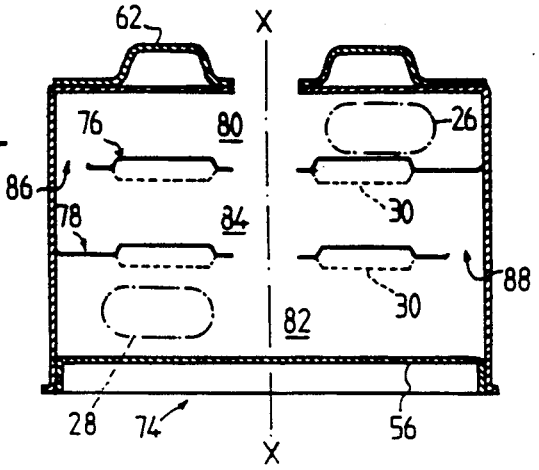
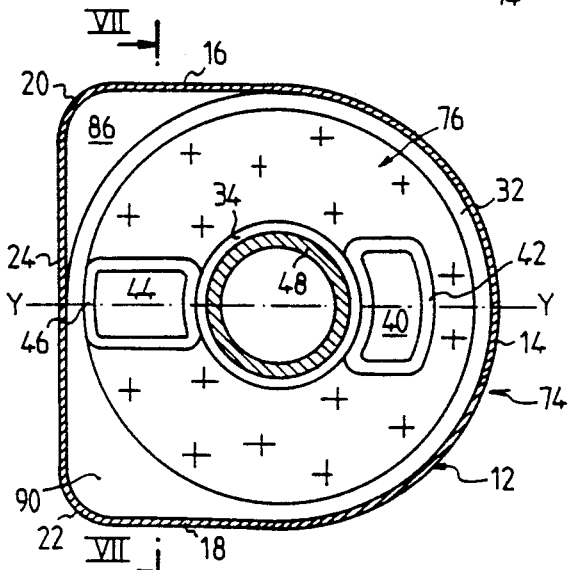
FIG. 5
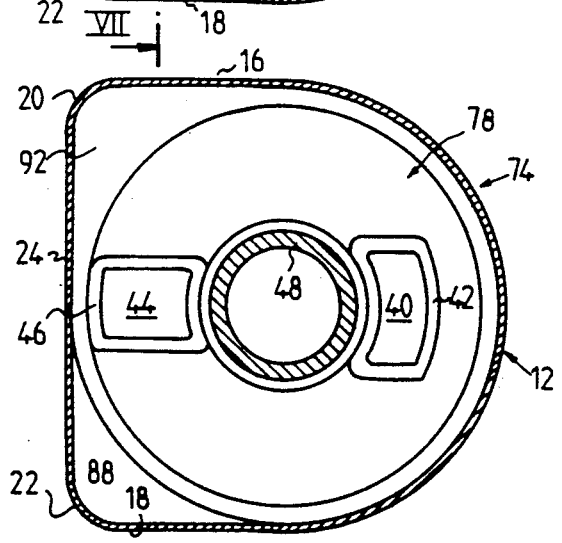
FIG. 6

FIG. 8
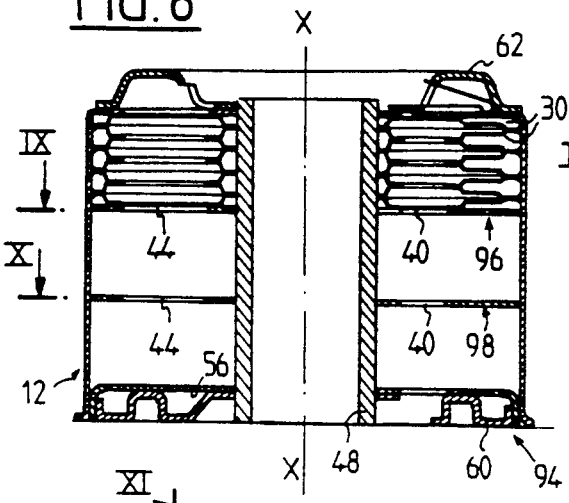
FIG. 11
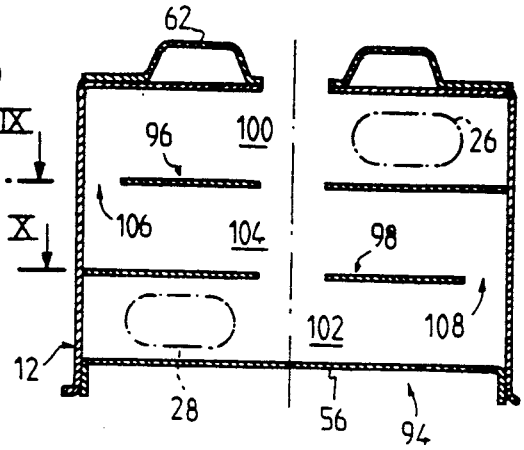
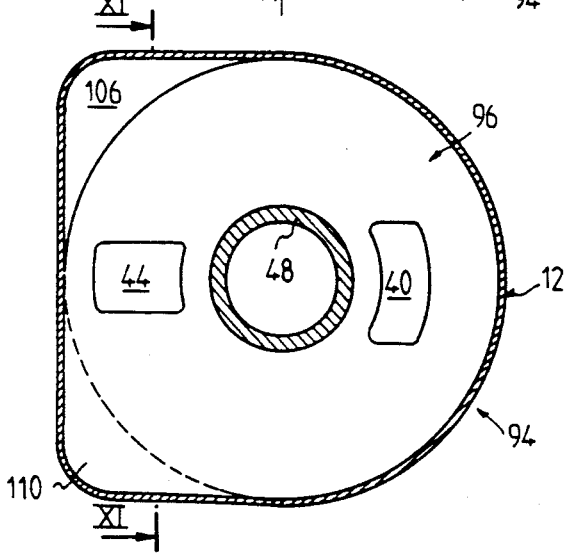
FIG. 9
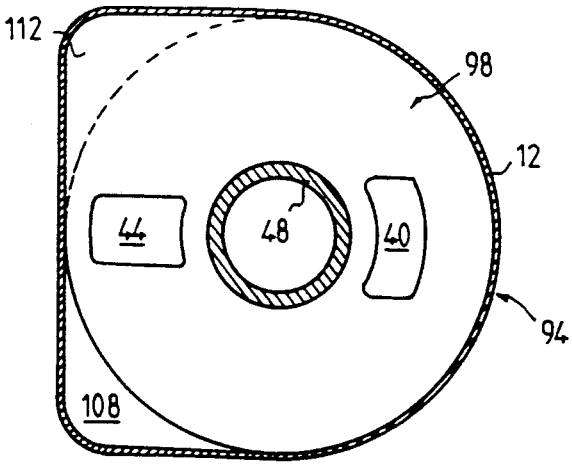
FIG. 10

FIG. 12
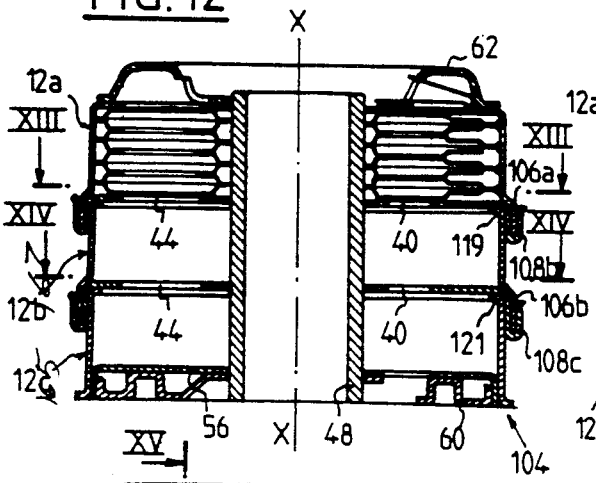
FIG. 15
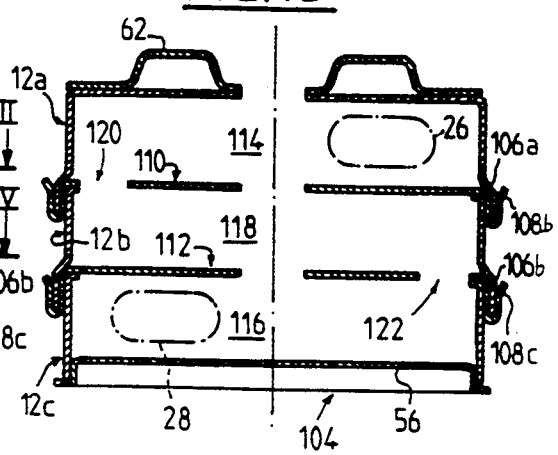
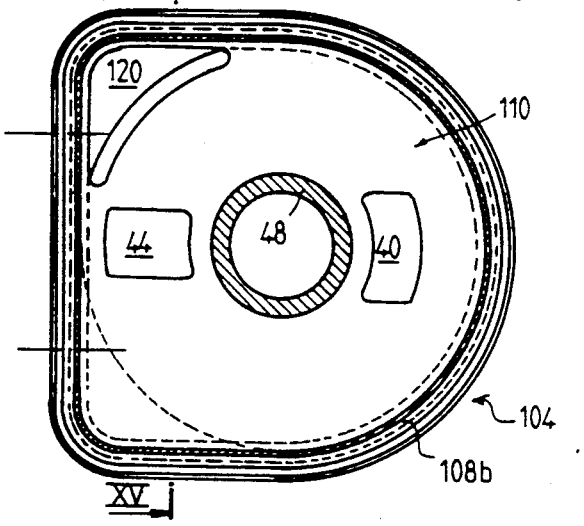
FIG. 13
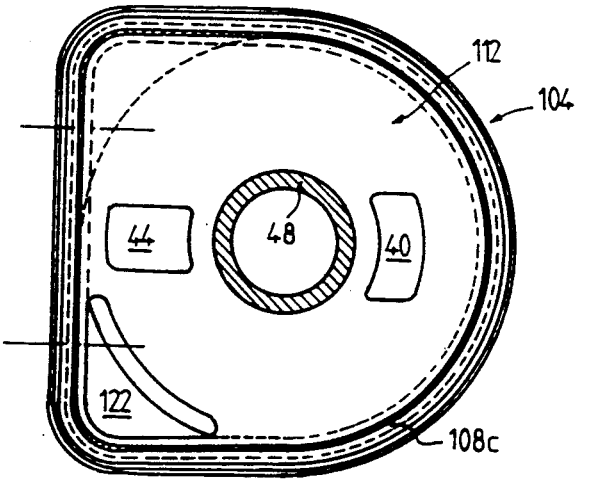
FIG. 14

FIG.16
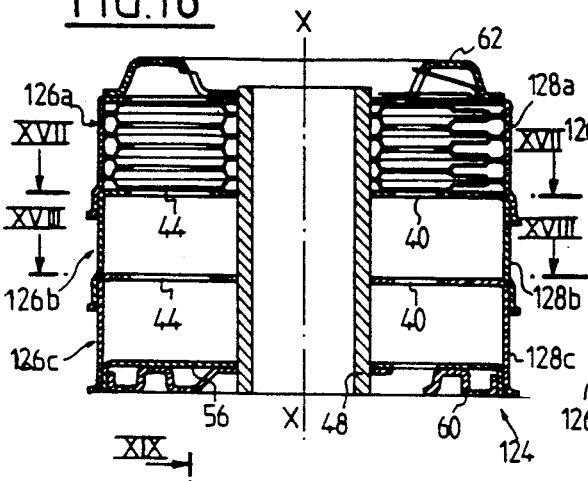
FIG. 19
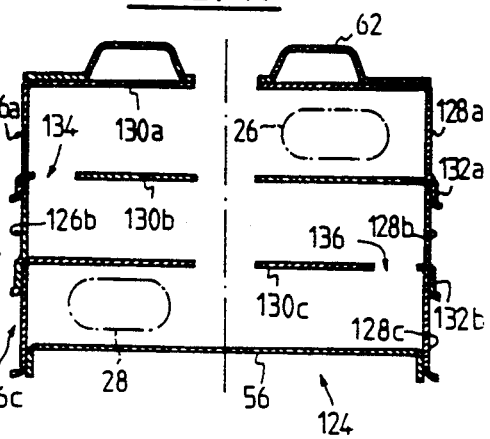
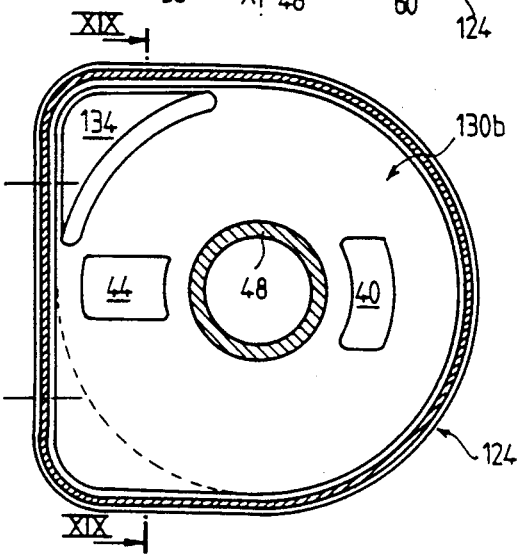
FIG.17
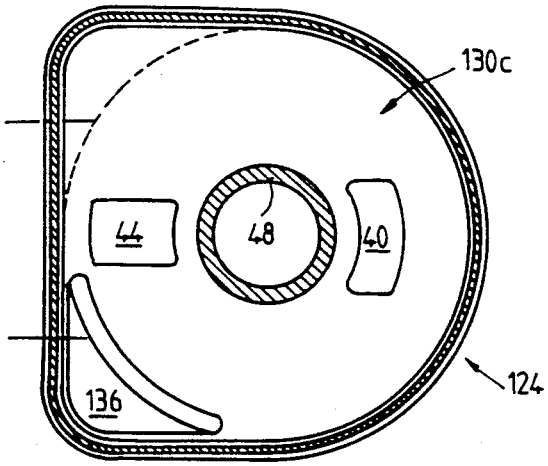
FIG. 18

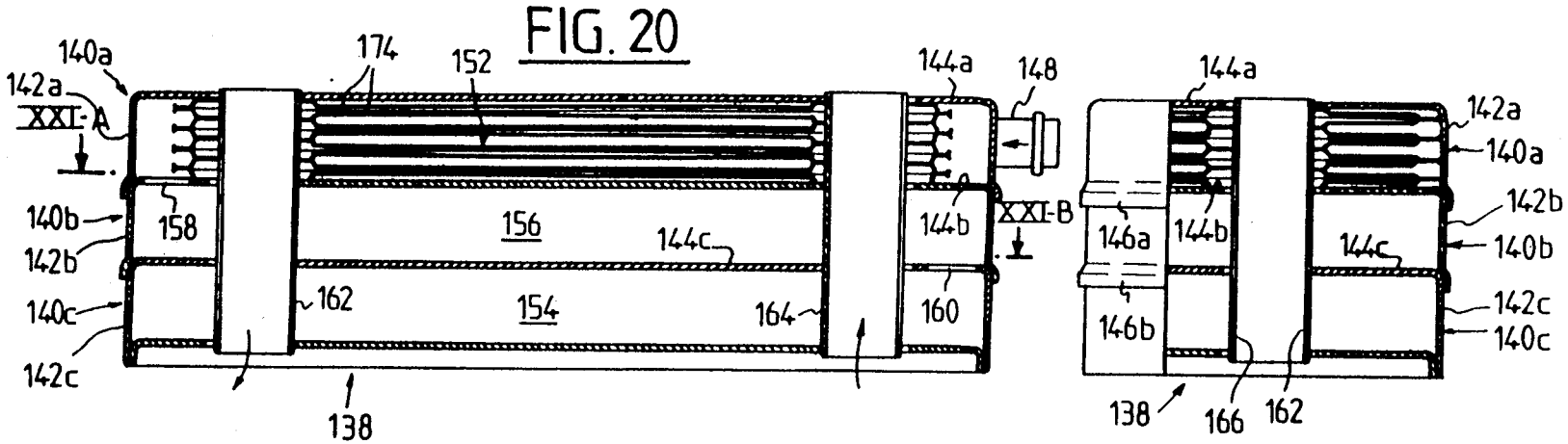
FIG. 22
FIG. 20
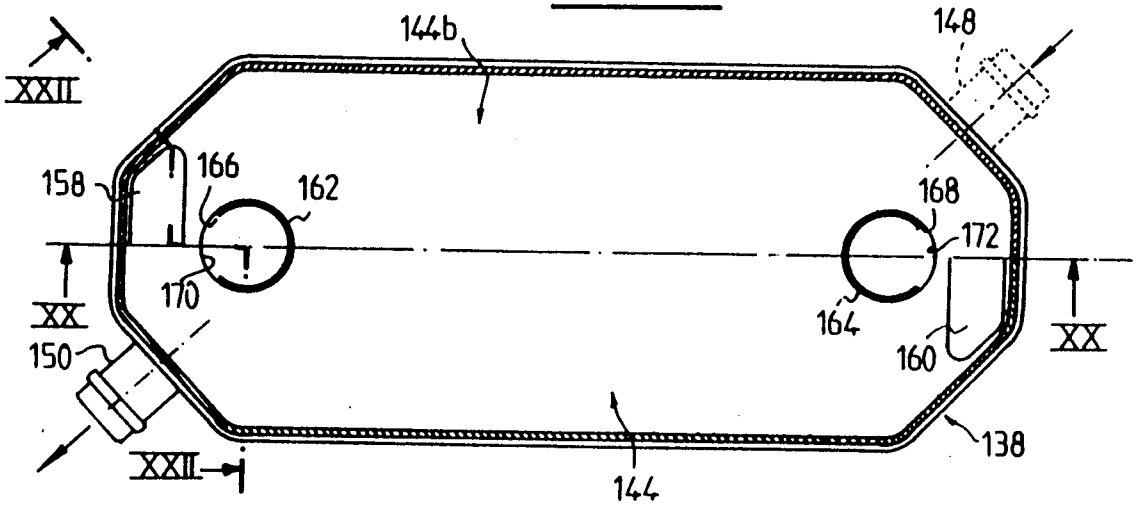
FIG. 21

PLATE TYPE HEAT ECHANGER, IN PARTICULAR FOR THE COOLING OF LUBRICATING OIL IN AN AUTOMOTIVE VEHICLE

FIELD OF THE INVENTION

This invention relates to a heat exchanger of the plate type, adapted for effecting heat transfer between two fluids, and especially (though not exclusively) to heat exchangers of this type for cooling lubricating oil, that is to say engine oil and/or gearbox oil, in an automotive vehicle.

BACKGROUND OF THE INVENTION

It is known to provide a plate type heat exchanger for effecting heat transfer between a first fluid, for example an oil which is to be cooled, and a second fluid, for example a coolant liquid, the heat exchanger comprising:

a casing which is provided with an inlet tube and an outlet tube for the second fluid;

a stack of plate elements (which will be referred to in this specification as "half-plates"), which are disposed in pairs in opposed or "back-to-back" relationship within the casing and which define a direction of stacking, in such a way in that the half-plates of any one pair form a hollow plate of the heat exchanger defining between the half-plates of the pair a flow passage for the first fluid, with adjacent hollow plates or pairs of half-plates defining between the pairs at their peripheries, within the casing, flow passages for the second fluid which communicate with each other; and communication means adapted to allow the first fluid to flow between the successive pairs of half-plates from a first fluid inlet to a first fluid outlet.

In this known type of heat exchanger, the half-plates are identical, each being in the general form of a disc having a circular peripheral lip and a circular internal lip. Thus, when the corresponding lips of two half-plates, arranged facing each other and forming one pair, are joined together (for example by brazing), so that the two half-plates then have the flow passage for flow of the first fluid, for example oil, through the hollow plate as mentioned above, this flow passage is annular.

In order to ensure the flow of the oil from one pair of half-plates to another, each oil passage is provided with two diametrically opposed flow ports, namely an inlet port and an outlet port, each of which is bounded by a lip which is arranged to be joined sealingly to a similar lip of an adjacent half-plate.

Such a known heat exchanger is used most typically for cooling lubricating oil from an engine block, and it includes a central tube around which the disc-shaped half-plates are stacked. A threaded bar, engaged within the tube, serves firstly to secure the heat exchanger onto the engine block, and secondly to secure an oil filter onto the heat exchanger itself. This hollow tube also provides a path for the return of the oil to the engine block, either directly through the tube itself or through the threaded bar, which will then be made hollow for this purpose.

In addition, this known type of heat exchanger includes a bypass which is provided with a flap valve that is normally open when the oil is cold and viscous, and closed when the oil is hot and fluid. In the open position of the flap valve, the oil passes directly through the heat exchanger from the oil inlet to the bypass, flowing through the inlet openings of the half-plates so that it reaches the filter directly and then returns to the engine through either the central tube or the central, hollow, threaded fastening bar. Under these circumstances, the oil is not cooled. However, when the flap valve is closed, the oil is distributed into each of the oil passages defined between the co-operating half-plates, through the inlet openings of the half-plates. The oil leaves each oil passage through the outlet openings of the half-plates, to go towards a passage communicating with the filter, from which it then returns to the engine as described above. This oil is cooled by heat transfer with the coolant liquid in the heat exchanger.

It has however been established that such a heat exchanger is not well adapted to give optimum heat transfer performance.

It is also known from the French published patent application No. FR 2 214 873A, to provide a plate type heat exchanger which does enable heat transfer performance to be improved, but at the expense of a far more complex structure than that of the known type of heat exchanger described above.

DISCUSSION OF THE INVENTION

A main object of the invention is to provide a plate type heat exchanger which is of the kind defined in the introductory part of this specification, but which enables heat exchange to be optimised and without it being necessary to provide a complex and costly structure.

To this end, the invention proposes a plate type heat exchanger of the said kind, which in accordance with an essential feature of the invention includes at least one cross wall, which is disposed parallel to the half-plates within the casing in order to define within the latter at least two chambers, each of which contains a defined number of pairs of half-plates, and into which the inlet and the outlet for the second fluid are respectively open, the cross wall including a flow opening having a selective configuration in order to ensure the flow of the second fluid from one chamber to another by creating forced circulation.

In this way, the performance of the plate type heat exchanger is optimised by means of a circuit for the second fluid, for example a coolant fluid, which may be considered to be a multiple pass circuit to the extent that the fluid passes successively through a plurality of chambers within the casing.

The heat exchanger according to the invention preferably includes at least two internal cross walls which are adapted to delimit at least three chambers within the casing, namely two end chambers into which the second fluid inlet and outlet are respectively open, together with at least one intermediate chamber. The number of cross walls is a function of the size of the heat exchanger and of the maximum permissible energy loss.

The respective flow openings formed in two adjacent cross walls are preferably not aligned with each other in a direction parallel to the stacking direction: in this way contraflow circulation can be set up in the second fluid from one chamber to the other.

In a first type of embodiment of the invention the, or each, cross wall serves the function of a half-plate of the heat exchanger, for which purpose it has the general configuration of the half-plate, but also has at least one extension portion such that the cross wall occupies the whole transverse cross section of the casing, the said extension portion being formed with the above mentioned flow opening.

In a second type of embodiment of the invention, the/or each cross wall is in the form of a flat plate, which is adapted to be arranged between two adjacent pairs of half-plates, and which has passage means to permit flow of the first fluid between the said adjacent pairs, the said cross wall occupying the whole transverse cross section of the casing and being formed with the flow opening for the second fluid.

In a first variant of this second embodiment of the invention, the casing comprises a single envelope wall, and the, or each, cross wall is carried on the inside of the envelope wall.

In another variant, the casing is formed of several casing members, each having a respective envelope wall, the casing members being assembled end to end and each cross wall being secured at its periphery in the joint between two envelope walls.

In a further variant, the casing is formed of a plurality of casing members, each of which comprises an envelope wall and a base portion, the casing members being assembled end to end, with the, or each, cross wall being defined by the base portion of a respective one of the casing members.

The description of preferred embodiments of the invention which follows is given by way of example only and with reference to the accompanying drawings.

BRIEF DESCRIPTION OF THE DRAWINGS

FIG. 1 is a view in longitudinal cross section taken on line 1—1 of FIG. 3 of a plate type heat exchanger in accordance with the prior art.

FIG. 2 is a detail of FIG. 1.

FIG. 3 is a view in cross section taken on the line III—III in FIG. 1.

FIG. 4 is a view in cross section showing a plate type heat exchanger in accordance with a first embodiment of the invention.

FIG. 5 is a view in cross section taken on the line V—V in FIG. 4.

FIG. 6 is a view in cross section taken on the line VI—VI in FIG. 4.

FIG. 7 is a view in cross section taken on the line VII—VII in FIG. 5.

FIG. 8 is a view in longitudinal cross section showing a heat exchanger in another embodiment of the invention.

FIG. 9 is a view in cross section taken on the line IX—IX in FIG. 8.

FIG. 10 is a view in cross section taken on the line X—X in FIG. 8.

FIG. 11 is a view in cross section taken on the line XI—XI in FIG. 9.

FIG. 12 is a view in longitudinal cross section showing a plate type heat exchanger in a further embodiment of the invention.

FIG. 13 is a view in cross section taken on the line XIII—XIII in FIG. 12.

FIG. 14 is a view in cross section taken on the line XIV—XIV in FIG. 12.

FIG. 15 is a view in cross section taken on the line XV—XV in FIG. 13.

FIG. 16 is a view in longitudinal cross section showing a plate type heat exchanger in accordance with yet another embodiment of the invention.

FIG. 17 is a view in cross section taken on the line XVII—XVII in FIG. 16.

FIG. 18 is a view in cross section taken on the line XVIII—XVIII in FIG. 16.

FIG. 19 is a view in cross section taken on the line XIX—XIX in FIG. 17.

FIG. 20 is a view in longitudinal cross section showing a plate type heat exchanger in accordance with the invention, in yet a further embodiment, the cross section being taken on the line XX—XX in FIG. 21.

FIG. 21 is a split cross sectional view, in which that part of the cross section lying above the line XX—XX is taken on the plane indicated at XXIA in FIG. 20, and the part below the line XX—XX is taken on the plane indicated in FIG. 20 at XXIB.

FIG. 22 is a view in cross section taken on the line XXII—XXII in FIG. 21.

DESCRIPTION OF PREFERRED EMBODIMENTS OF THE INVENTION

Reference is made first of all to FIGS. 1 to 3, which show a plate type heat exchanger in accordance with the prior art, for use in cooling the lubricating oil in the engine of an automotive vehicle. The heat exchanger 10 includes a casing 12 having an envelope wall which is defined by generatrices parallel to an axis XX. This envelope wall can be seen in FIG. 3, and includes a semi-cylindrical wall portion 14 which is joined to two parallel, flat wall portions 16 and 18. The wall portions 16 and 18 are joined through respective rounded corners 20 and 22 to a flat wall portion 24 which is perpendicular to the wall portions 16 and 18. Two short tubes 26 and 28 project from the wall portion 24, and serve respectively as the input and the output for the coolant liquid, which may for example be a glycol-water mixture.

The heat exchanger also includes a stack of plates 30 which are arranged in pairs of plates arranged back-to-back inside the casing 12. They are stacked in a direction parallel to the axis XX. The plates 30, which will be referred to as "half-plates" in this description, are identical to each other; and each half-plate 30 is generally in the form of a disc which is formed with a circular peripheral lip 32 and a circular inner lip 34, as can be seen from FIG. 3. The lips 32 and 34 lie in a common plane, whereas the annular region 36 of the half-plate 30, which lies between the two lips 32 and 34, lies in a different plane from that of the two lips. Thus, when the corresponding lips of two half-plates which are laid together in opposed relationship are placed together so as to form a pair of half-plates, the latter define an annular, hollow plate 38 (see FIGS. 1 and 2), the interior of which constitutes an annular passage through which the oil is to flow.

Each hollow plate 38 has two diametrically opposed ports to enable oil to flow from one pair of half-plates 30 to another, that is to say from one hollow plate 38 to another. These ports comprise an inlet port 40, which is bounded by a peripheral lip 42, and an exit port 44 which is bounded by a peripheral lip 46. Each of the lips 42 and 46 is arranged to be joined in a sealing manner with a corresponding port of an adjacent half-plate 30. The half-plates 30 are preferably joined together by brazing.

The stack of hollow plates 30 is inserted into the casing 12 around a central tube 48 which is centered on the axis XX. Thus, the lips 34 of the half-plates 30 come into contact against the outer surface of the tube 48, while the lips 32 come into contact agains the internal face of the semi-cylindrical wall portion 14, while also engaging the internal face of the wall portion 24 tangentially. This arrangement then defines two regions 50 and 52 (see FIG. 3), through which coolant liquid circulates within the casing 12. The pairs of half-plates 30 define between themselves, and at their periphery within the casing 12, further hollow spaces 54, which can be seen in FIGS. 1 and 2 and which are in communication with each other and with the coolant circulation regions 50 and 52.

The exchanger 10 also has an annular base 56, in which an opening 58 is formed in line with the inlet ports 40 so as to constitute the oil inlet for the heat exchanger itself. The base 56 is retained in position by a seal-carrying retaining member 60 which is disposed between the envelope of the casing 12 and the central tube 48.

At its other end the heat exchanger has another seal-carrying retaining member 62, which is secured to the envelope wall of the casing 12 and to the central tube 48. The member 62 is formed with a bypass 64 which lies in axial alignment with the inlet ports 40 and which is controlled by a flap valve 66. The member 62 is also formed with a flow opening 68 which is arranged in line with the exit ports 44.

The heat exchanger 10 is adapted to be secured on an engine block 70, and to receive an oil filter 72, the engine block 70 and filter 72 being indicated diagramatically in FIG. 1. The heat exchanger is fastened onto the engine block, and the oil filter 72 is fastened on the heat exchanger itself by for example, a hollow threaded rod (not shown) in the manner described in the French patent application No. FR 2 214 873A (7302134) mentioned above.

The heat exchanger 10 operates in the following manner. When the oil is cold and viscous, it passes into the heat exchanger 10 through the oil inlet opening 58, and its high viscosity gives rise to an increase in pressure which causes the flap valve 66 to open. The oil passes directly through the heat exchanger from the inlet 58 to the bypass 64, via the inlet ports 40 formed in the half-plates 30. The oil then passes through the filter and returns to the engine block 70 through the central tube 48.

When the oil is hot and fluid, the flap valve 66 is closed. The oil is then distributed into each oil passage 38 through the inlet ports 40, so that it then gradually rises up to the flow opening 68. The oil then passes through the filter 72 and returns to the engine block through the central tube 48.

As has already been indicated above, this known type of heat exchanger does not allow optimisation of the heat exchange between the coolant liquid and the oil.

Reference will now be made to FIGS. 4 to 7, which show a heat exchanger 74 in accordance with the invention, in which the general structure of the heat exchanger 10 seen in FIGS. 1 to 3 is repeated. Those elements that are common to both heat exchangers are indicated in FIGS. 4 to 7 by the same reference numerals as in FIGS. 1 to 3.

The heat exchanger 74 has two cross walls 76 and 78, the relative disposition of which is best shown in FIG. 7 (from which the half-plates 30 have been omitted in the interests of clarity of the drawing). These cross walls 76 and 78 are arranged parallel to the hollow plates or oil passages 38, formed by the half-plates 30 (FIG. 4). The cross walls 76 and 78 define three chambers within the casing 12, namely two end chambers 80 and 82, into which the inlet tube 26 and the outlet tube 28 are open; and an intermediate chamber 84. The intermediate chamber 84 communicates with the upper end chamber 80 through a flow opening 86, and with the lower end chamber 82 through a flow opening 88. The configuration of each flow opening 86, 88 is defined by the respective cross wall 76 or 78, as seen in FIGS. 5 and 6. Thus, the flow openings 86 and 88 are not aligned axially in a direction parallel to the stacking axis XX; and this causes contraflow circulation to take place in these chambers.

In the embodiment shown in FIGS. 4 to 7, each of the cross walls 76 and 78 fulfils the function of a half-plate 30, and each cross wall is associated with a normal half-plate 30 (shown in broken lines in FIG. 7), so as to define a pair of half-plates enclosing an oil circulation passage. As is shown in FIG. 5, the cross wall 76 has the general configuration of one half-plate, and again includes lips 32 and 34, as well as lips 42 and 46 which surround its inlet and outlet openings 40 and 44 respectively. However, the cross wall 76 also has an extension portion 90 which extends into the coolant circulation region 52 of the casing 12. This extension portion 90 bears sealingly against the inner face of the envelope of the casing in the vicinity of its wall portions 18, 22 and 24. It will be noted, however, that the cross wall 76 does not extend into the coolant circulation region 50 of the casing in such a way that it would restrict the flow opening or passage 86 in the region 50.

The cross wall 78, which is shown in FIG. 6, is symmetrical in shape to the cross wall 76, with reference to a common axis YY shown in FIG. 5. The cross wall 78 thus has an extension portion 92 which extends into the internal space or coolant circulation region 50 of the casing. Here it is the internal space 52 of the casing that is not intercepted by the cross wall, so that a flow opening or passage 88 is left open in the region 52. The heat exchanger of FIGS. 4 to 7 gives improved heat exchange performance, given that the coolant liquid first circulates in the chamber 80, within the coolant passages 54 (see FIG. 2) and then passes through the cross wall 76 via the opening 86, after which it circulates in contraflow in the chamber 84 and in those oil passages 54 that are arranged in this chamber. The coolant liquid then passes through the flow opening 88 so as to arrive in the lower end chamber 82, in which it circulates in cross flow before finally leaving the casing 12 via the outlet tube 28.

Reference is now made to FIGS. 8 to 11, which show another embodiment of the heat exchanger in accordance with the invention. This heat exchanger again includes elements that are common with that of FIGS. 1 to 3, and also elements common with that of FIGS. 4 to 7. These common elements are again indicated by the same reference numerals as in the corresponding preceding Figures.

The heat exchanger 94 has two internal cross walls 96 and 98, which in this example consist of simple flat plates, the general contour of which is the same as that of the cross walls 76 and 78 in the previous embodiments. Each of the cross walls 96 and 98 extends in a plane perpendicular to the axis XX, and the two cross walls are spaced from each other so as to define three chambers within the casing 12. These chambers comprise two chambers 100 and 102 into which the inlet and outlet tubes 26 and 28, respectively, are open; and an intermediate chamber 104. The cross walls 96 and 98 define respective openings 106 and 108, through which the three chambers are in communication with each other. As can be seen in FIG. 9, the cross wall 96 has an extension portion 110 which extends into the internal coolant circulation region 52 of the casing 12, the other coolant circulation region 50 being free so as to define the opening 106. Similarly, the cross wall 98 includes an extension portion 112 which extends into the internal coolant circulation region 50, and in this case it is the coolant circulation region 52 that is free so as to define the opening 108.

Operation of the heat exchanger 94 is the same as that of the heat exchanger 74 shown in FIGS. 5 to 7.

Reference is now made to FIGS. 12 to 15, which show a heat exchanger 104 which is similar to the heat exchanger 94 of FIGS. 8 to 11. The heat exchanger 104 comprises three casing members 12*a*, 12*b* and 12*c*, the respective envelope walls of which are assembled end to end. The casing members 12*a* and 12*b* have respective edges 106*a* and 106*b*. Within the casing that comprises the three members 12*a*, 12*b* and 12*c*, two cross walls 110 and 112 are arranged. Each of the cross walls 110 and 112 is in the form of a flat plate, the shape of which is substantially the same as that of the cross walls 96 and 98 in the embodiment of FIGS. 8 to 11. The cross walls 110 and 112 define within the casing two end chambers 114 and 116, into which the inlet and outlet tubes 26, 28 are respectively open; and an intermediate chamber 118. These chambers 114, 118 and 116 communicate with each other through openings 120 and 122 defined respectively by the cross walls 110 and 112.

As can be seen from FIGS. 13 and 14, the cross walls 110 and 112 have respective curled edges 108*b* and 108*c*. When the casing members 12*a*, 12*b* and 12*c* are being assembled together, the curled edge 108*b* of the cross wall 110 receives within it the lower terminal edge portion 106*a* of the upper casing member 12*a*, while the upper terminal edge 119 of the casing member 12*b* bears against the cross wall 110, so that the latter is trapped between the two casing members 12*a* and 12*b*. Similarly, the upper terminal edge 121 of the lower casing member 12*c* traps the curled edge 108*c* of the lower cross wall 112 between the intermediate casing member 12*b* and the lower casing member 12*c*.

The heat exchanger 104 operates in the same way as the heat exchangers 74 and 94 described with reference to FIGS. 4 to 7, and FIGS. 8 to 11, respectively.

Reference will now be made to FIGS. 16 to 19. These show a heat exchanger 124 in a further embodiment of the invention. This heat exchanger has three casing elements 126*a*, 126*b*, and 126*c*, having respective envelope walls 128*a*, 128*b*, and 128*c*, each of which is joined to an annular base portion 130*a*, 130*b*, and 130*c* of the respective casing member. Each of the envelope walls 128*a* and 128*b* has at its other terminal edge a flared lip 132*a*, 132*b* respectively, which enables the upper casing member 126*a* to be nested directly onto the intermediate casing member 126*b*, and the latter to be nested directly onto the lower casing member 126*c*. The base portions 130*b* and 130*c* themselves constitute the cross walls of the casing, and are of the same general shape as the cross walls 110 and 112 in the heat exchanger 104 described above with reference to FIGS. 12 to 15. In particular, the base portions 130*b* and 130*c* define respective openings 134 and 136 through which the coolant liquid can pass from one chamber to the next. The operation of the heat exchanger 124 is the same as that of the heat exchangers 74, 94 and 104 already described.

Reference will now be made to FIGS. 20 to 22, which show a further heat exchanger that is adapted more particularly for use in cooling the oil from an automatic gearbox. This heat exchanger, 138, comprises three casing members 140*a*, 140*b* and 140*c*. Each of these members has a respective envelope wall 142*a*, 142*b*, 142*c*. Each of these envelope walls has the general shape in transverse cross section of an elongated octagon (see FIG. 21). Each of the envelope walls 142*a*, 142*b* and 142*c* has a base wall 144*a*, 144*b* and 144*c* respectively, from which the envelope wall depends in the manner of a skirt.

In addition, the skirt walls 142*a* and 142*b* have flared lower terminal edges, 146*a*, 146*b* respectively, whereby the upper casing member 140*a* can be nested in the intermediate casing member 140*b*, and the latter can be nested in the lower casing member 140*c*. A coolant inlet tube 148 is provided on the upper casing member 140*a*, and a coolant outlet tube 150 is provided on the lower casing member 140*c*. The three casing members thus define three chambers, namely two end chambers 152 and 154 into which the tubes 148 and 150 are open respectively, together with an intermediate chamber 156. The base portions 144*b* and 144*c*, one half of each of which can be seen in FIG. 21, also constitute the cross walls of the heat exchanger and are in the form of elongated octagons. Passages 158 and 156, not aligned with each other, are provided in the base portions 144*b* and 144*c* respectively.

The heat exchanger 138 includes, in addition, two tubes 162 and 164, which extend through the casing elements, and each of which has a longitudinal slot 166, 168 respectively. The two tubes 162 and 164 extend through respective openings 170 and 172 formed in the base portions 144*b* and 144*c*, as can be seen in FIG. 21. In each of the chambers 152, 154 and 156, there is a stack of half-plates 174, which are arranged in pairs in a similar way to the half-plates 30 described above. As can be seen in FIGS. 20 and 22, the heat exchanger has four pairs of half-plates 174 in the upper chamber 152. Similarly, there are four pairs of half-plates (not shown) in each of the other two chambers 156 and 154. These half-plates do not extend as far as the two end walls 176 and 178, thus defining empty spaces within the casing.

The coolant liquid flows through the inlet tube 148, circulates in the chamber 152, and leaves the latter via the opening 158 so as then to circulate in contraflow in the intermediate chamber 156. It leaves the latter through the opening 160 and then circulates in contraflow in the lower chamber 154, before leaving the heat exchanger through the outlet tube 150.

The oil to be cooled flows through the slotted tube 164 and is distributed by means of the slot 168 into the oil passages defined between the half-plates 174 of each pair. The oil then flows through the slot 166 into the tube 162, through which it finally leaves the heat exchanger.

Although the invention has been described with reference to heat exchangers which are intended for the cooling of lubricating oil in an automotive vehicle, it may be applied generally to heat exchangers for transferring heat between two fluids.

What is claimed is:

1. A plate type heat exchanger for effecting heat transfer between a first fluid and a second fluid, comprising a casing having top and bottom covers and at least one planar side wall, an inlet means for the second fluid carried by the casing, an outlet means for the second fluid carried by the casing, at least one of said second fluid inlet and outlet means connected to said at least one planar side wall, and a stack of half-plates mounted within the casing and defining a direction of stacking, the half-plates being arranged in pairs of opposed half-plates so that each said pair defines within it a flow passage for the first fluid, with the pairs of half-plates defining at their peripheries, and within the casing, flow passages for the second fluid in communication with each other, the half-plates further having communicating means for flow of the first fluid through said communicating means between successive pairs of half-plates, and the heat exchanger further comprising an inlet for the first fluid and an outlet for the first fluid, said first fluid inlet and outlet being in communication with said flow passages for the first fluid so that said circulation of the latter is from the first fluid inlet to the first fluid outlet, the heat exchanger further including at least one cross wall arranged within the casing parallel to the half-plates so as to define within the casing at least two chambers, there being a plurality of said half-plate pairs in each said chamber, each of said inlet and outlet means for the second fluid being open into a respective one of said two chambers, and each cross wall defining a flow opening of a selected configuration for ensuring the circulation of the second fluid from one chamber to the other by setting up forced circulation.

2. A heat exchanger according to claim 1, having at least two said internal cross walls defining at least three said chambers within the casing, wherein said chambers comprise a first end chamber into which the inlet for the second fluid is open and a second chamber into which said outlet for the second fluid is open, together with an intermediate chamber between said first and second chambers.

3. A heat exchanger according to claim 2, wherein said flow openings of two adjacent cross walls are out of alignment with each other in a direction parallel to said stacking direction, whereby to create contraflow circulation of the second fluid from one chamber to the other.

4. A heat exchanger according to claim 1, wherein the or each cross wall has the same general configuration as a said half-plate but includes at least one extension portion, such that while the cross wall functions as one of the half plates, and defines said flow opening for said fluid, the cross wall occupies substantially the whole of the remainder of the transverse cross section of the casing.

5. A heat exchanger according to claim 1, wherein the or each cross wall is a flat plate disposed between two pairs of adjacent half-plates, the cross wall defining flow means for enabling the first fluid to pass between said adjacent pairs of half-plates and defining said flow passage for the second fluid, the said cross wall occupying substantially the whole of remainder of the transverse cross section of the casing.

6. A heat exchanger according to claim 5, wherein the casing has a single envelope wall with the or each cross wall being bearing sealingly against the interior of the envelope wall of the casing.

7. A heat exchanger according to claim 3, wherein said casing comprises a part circular section joined by two straight sections to form a U-shaped section, said at least one planar side wall comprising a single planar section joining said two straight sections at rounded corners to close off said U-shaped section and said flow openings in said cross walls being located within the casing in the neighborhood of said rounded corners.

8. A heat exchanger as claimed in claim 2, wherein said casing comprises 8 planar side wall sections forming an elongated octagon.

9. A heat exchanger as claimed in claim 8, wherein said inlet and outlet means of said second fluid are located opposite each other on the shorter ends of said elongated octagon.

10. A heat exchanger according to claim 1, wherein the flow passage for said first fluid comprises first and second flow passages through said heat exchanger half plates, said first flow passage being defined by a perimeter lip in each half-plate, said perimeter lips being bonded to each other in a fluid tight relationship to form said first flow passage, said first flow passage being located between said inlet and outlet means for said second fluid to aid in an even distribution of the second fluid flow across the half-plates in each of said chambers.

11. A plate type heat exchanger for effecting heat transfer between a first fluid and a second fluid, comprising a casing, an inlet for the second fluid carried by the casing, an outlet for the second fluid carried by the casing, and a stack of half-plates mounted within the casing and defining a direction of stacking, the half-plates being arranged in pairs of opposed half-plates so that each said pair defines within it a flow passage for the first fluid, with the pairs of half-plates defining at their peripheries, and within the casing, flow passages for the second fluid in communication with each other, the half-plates further having communicating means for flow of the first fluid through said communicating means between successive pairs of half-plates, and the heat exchanger further comprising an inlet for the first fluid and an outlet for the first fluid, said first fluid inlet and outlet being in communication with said flow passages for the first fluid so that said circulation of the latter is from the first fluid inlet to the first fluid outlet, the heat exchanger further including at least one cross wall arranged within the casing parallel to the half-plates so as to define within the casing at least two chambers, there being a plurality of said half-plates in each said chamber, each of said inlet and outlet means for the second fluid being open into a respective one of said two chambers, and the or each cross wall defining a flow opening of a selected configuration for ensuring the circulation of the second fluid from one chamber to the other by setting up forced circulation, and wherein the or each cross wall is a flat plate disposed between two pairs of adjacent half-plates, the or each cross wall defining flow means for enabling the first fluid to pass between said adjacent pairs of half-plates and defining said flow passage for the second fluid, said cross wall occupying substantially the whole of the remainder of the transverse cross section of the casing wherein the casing comprises a plurality of casing members, at least one of which comprises an envelope wall and a base portion joined to the envelope wall and defining a cross wall.

12. A plate type heat exchanger for effecting heat transfer between a first fluid and a second fluid, comprising a casing, an inlet for the second fluid carried by the casing, an outlet for the second fluid carried by the casing, and a stack of half-plates mounted within the casing and defining a direction of stacking, the half-plates being arranged in pairs of opposed half-plates so that each said pair defines within it a flow passage for the first fluid, with the pairs of half-plates defining at their peripheries, and within the casing, flow passages for the second fluid in communication with each other, the half-plates further having communicating means for flow of the first fluid through said communicating means between successive pairs of half-plates, and the heat exchanger further comprising an inlet for the first fluid and an outlet for the first fluid, said first fluid inlet and outlet being in communication with said flow passages for the first fluid so that said circulation of the latter is from the first fluid inlet to the first fluid outlet, the heat exchanger further including at least one cross wall arranged within the casing parallel to the half-plates so as to define within the casing at least two chambers, there being a plurality of said half-plates in each said chamber, each of said inlet and outlet means for the second fluid being open into a respective one of said two chambers, and each cross wall defining a flow opening of a selected configuration for ensuring the circulation of the second fluid from one chamber to the other by setting up forced circulation, and wherein the or each cross wall has the same general configuration as a said half-plate but includes at least one extension portion, such that while the or each cross wall functions as one of the half plates, and defines said flow opening for said fluid, the or each cross wall occupies substantially the whole of the remainder of the transverse cross section of the casing wherein the casing comprises a plurality of casing members, each having an envelope wall, the casing members being arranged end to end and the or each cross wall being held at its periphery by and between two said envelope walls.

* * * * *